United States Patent [19]

Ell

[11] 4,074,116

[45] Feb. 14, 1978

[54] SELECTOR

[76] Inventor: William M. Ell, 5513 Trent Court, Apt. 261, Alexandria, Va. 22311

[21] Appl. No.: 732,277

[22] Filed: Oct. 14, 1976

[51] Int. Cl.[2] ..... G06C 27/00; G06C 1/02

[52] U.S. Cl. ..... 235/83; 235/61 B; 235/84

[58] Field of Search ..... 235/83, 84, 88 R, 88 N, 235/70 A, 61 B, 61 GM

[56] References Cited

U.S. PATENT DOCUMENTS

| | | | |
|---|---|---|---|
| 2,118,773 | 5/1938 | Ball | 235/83 |
| 2,283,375 | 5/1942 | Lautzenhiser et al. | 235/61 B |
| 2,551,997 | 5/1951 | Cody | 235/61 B |
| 2,892,586 | 6/1959 | Graham | 235/61 GM |
| 3,076,596 | 2/1963 | Jaderholm | 235/84 |
| 3,784,797 | 1/1974 | Kroll | 235/88 |
| 3,878,368 | 4/1975 | Ell | 235/83 |

*Primary Examiner*—Stephen L. Tomsky
*Attorney, Agent, or Firm*—Frederick W. Turnbull

[57] ABSTRACT

A device for selection of compressors, condensers, expansion valves, and evaporators for air conditioning or refrigeration systems.

7 Claims, 3 Drawing Figures

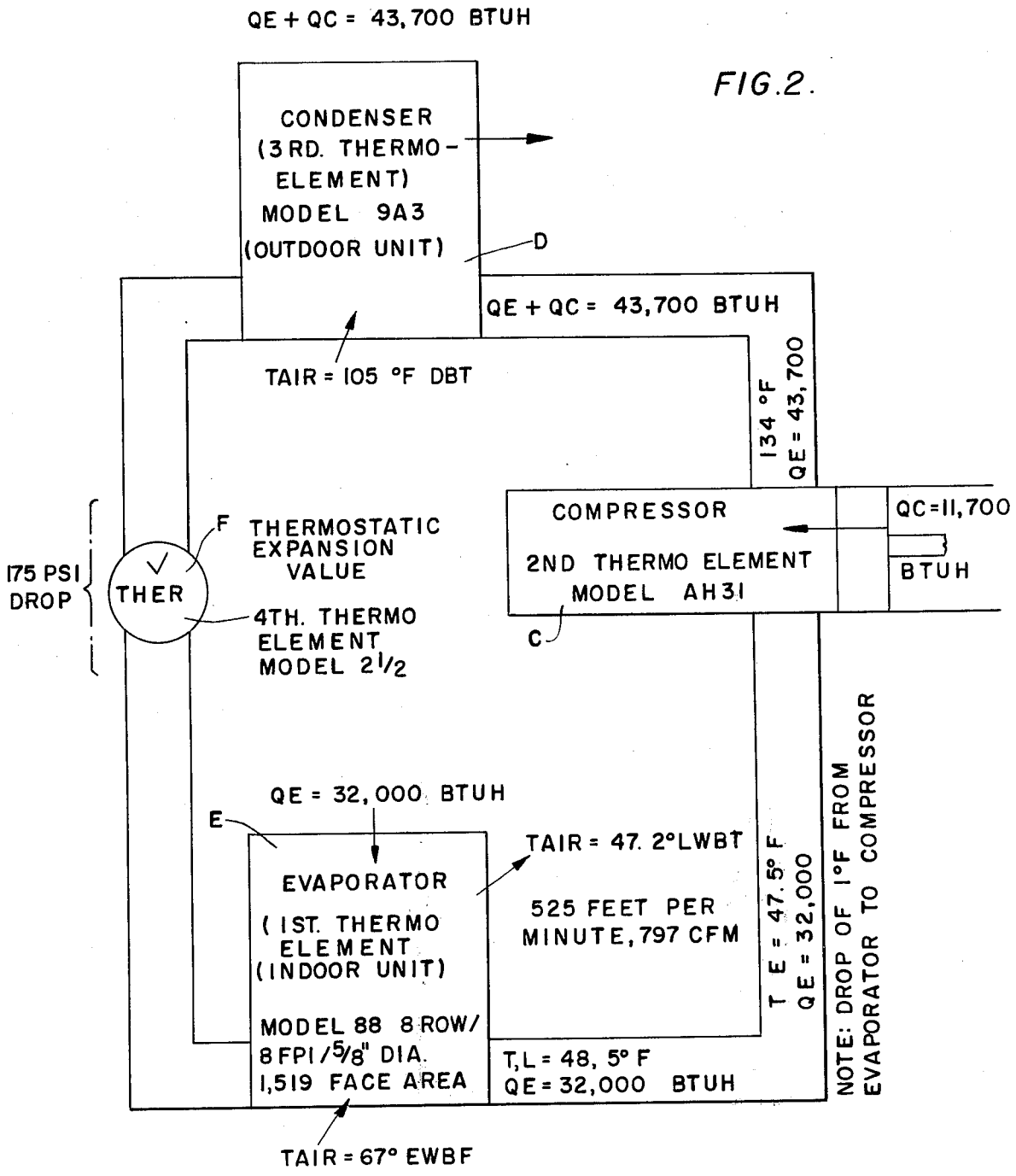
QE + QC = 43,700 BTUH
FIG.2.
CONDENSER
(3RD. THERMO-
ELEMENT)
MODEL 9A3
(OUTDOOR UNIT)
D
QE + QC = 43,700 BTUH
TAIR = 105 °F DBT
134 °F
QE = 43,700
COMPRESSOR
2ND THERMO ELEMENT
MODEL AH31
QC=11,700
BTUH
C
F
THERMOSTATIC
EXPANSION
VALUE
175 PSI
DROP
THER
4TH. THERMO
ELEMENT
MODEL 2 1/2
QE = 32,000 BTUH
E
EVAPORATOR
(1ST. THERMO
ELEMENT
(INDOOR UNIT)
MODEL 88 8 ROW/
8 FPI/5/8" DIA.
1,519 FACE AREA
TAIR = 47.2°LWBT
525 FEET PER
MINUTE, 797 CFM
T E = 47.5° F
QE = 32,000
T,L = 48, 5° F
QE = 32,000 BTUH
NOTE: DROP OF 1°F FROM
EVAPORATOR TO COMPRESSOR
TAIR = 67° EWBF

SELECTOR

This application is an improvement over the device of U.S. Pat. No. 3,878,368 issued Apr. 15, 1975.

In designing air conditioning or refrigeration systems it is necessary to determine the B.T.U.H. that must be removed from the space to be cooled. This computation, however, does not inform the designer of what components are available for use to remove the B.T.U.H. from the space.

It is a primary object of the present invention to provide a portable selector so that once the B.T.U.H. requirements of the system are known, appropriate components may be selected by catalogue number of the maker of the components without consultation of tabulations and/or charts, the catalogue numbers being carried by the selector.

Another object of the invention is the provision of a portable, manually operable selector for components of a cooling system by which various conditions may be considered having to do with variables presented by different climatic or other local conditions at the cite of the installation being designed.

It is yet a further object of this invention to provide a portable device indicating by non-formula curves information to provide for selection of equipment of a specific manufacturer.

Other and further objects and advantages will become apparent from the following specification taken with the accompanying drawing in which like reference characters refer to similar parts in the several views and in which:

FIG. 2 is a diagramatic air conditioning circuit showing specific thermodynamic values as an illustration.

Figure 1A:
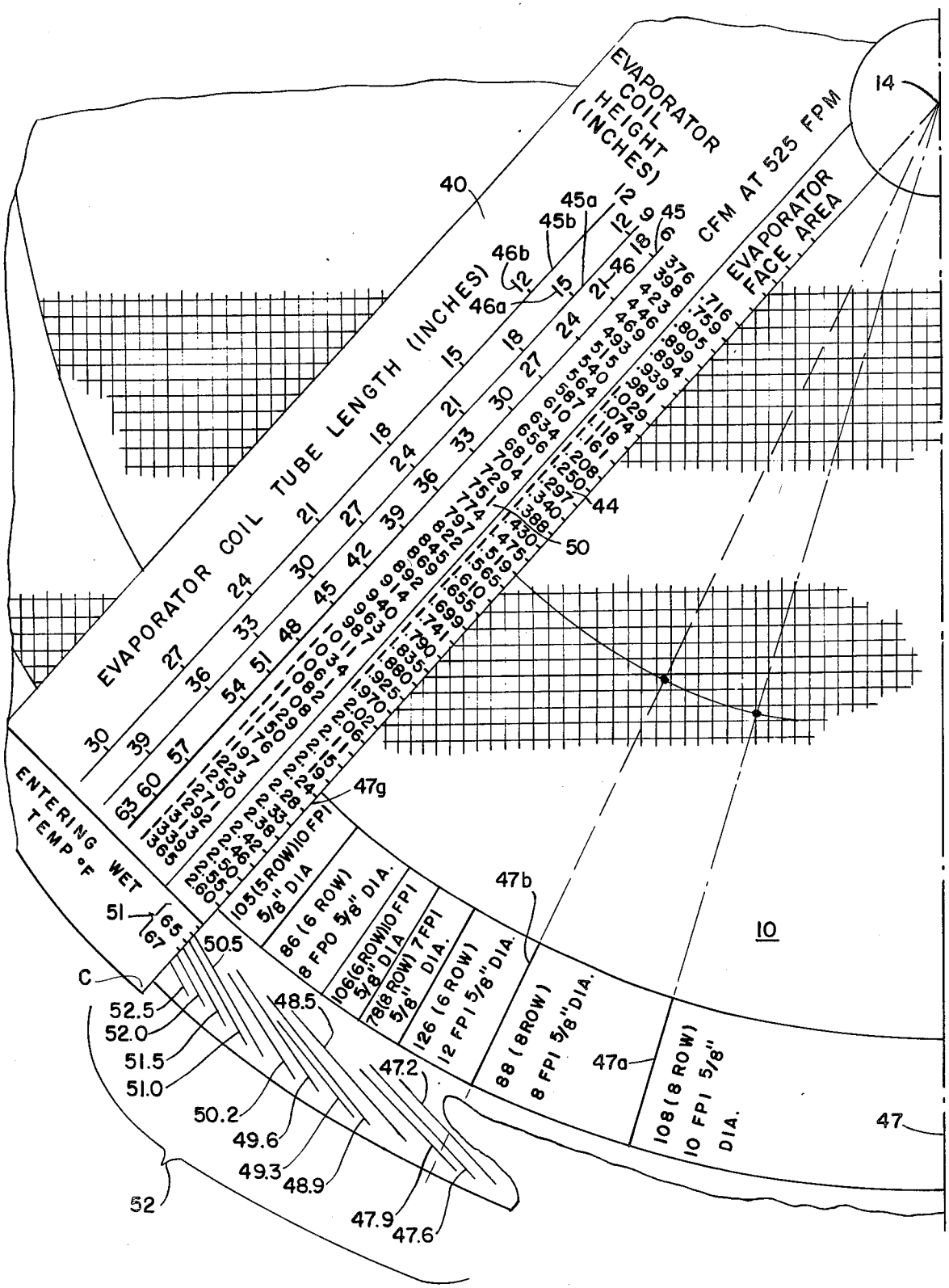
FIG. 1A is an enlarged view of the second quadrant

The device comprises a flat base 10 carrying appropriate lines, numerals, and curves 28, 28*a*, and 30, 30*a* on a first quadrant, and a first pivoted radial arm 12 with a fixed pointer 26, slideable pointer 24 with the accompanying indicia as disclosed in U.S. Pat. No. 3,878,368 mounted to swing over the first quadrant of said base, and includes also a second arm 40 pivoted at the same point 14 to said base to swing over an adjacent or second quadrant of said base, said arm 40 carrying indicia relating to evaporators. Said first pivoted radial arm 12 also carries a rotatable disc 43 on which indicia relative to air velocities through evaporators of different structures appears.

The device also comprises, in connection with the curves 28, and 28*a* on the base that are used for selecting a compressor, which are disclosed in U.S. Pat. No. 3,818,368, additional curves for selecting an expansion valve; and in connection with the curves 30 and 30*a* on the base for selecting a condenser indicating ambient air temperatures, curves showing the CFM of air required appear which are labeled with catalogue nunbers of condensers that may be selected for use in the installation using that ambient air temperature and at that CFM.

Component balancing for "electric type" air conditioning units generally deviate from the "actual" vapor-compression refrigerant cycle and generally tend to follow simplified thermodynamic concepts closely resembling the "ideal" vapor compression refrigerent cycle. The following text and drawings, as well as those in U.S. Pat. No. 3,878,368, accordingly follow these commonly used simplifed concepts.

After the B.T.U.H. required for the installation has been determined, the device of the present invention provides a means to select the most suitable evaporator, compressor, expansion valve and condenser, for the system to provide the most economical installation without requiring reference to many tables and charts that refer separately to each element.

There are four thermodynamic components (evaporator, compressor, condenser, and thermostatic expansion valve or capillary tube) within the electric type air conditioning unit. These components can each be purchased separately, or as partial packages such as a condensing unit which includes a packaged compressor with condenser, or as a single package of four components. The description of this disclosure is based on separate units. Minor modifications would be made to the selector, if required for partial packages or single package units.

Added to the structure which is disclosed in U.S. Pat. No. 3,878,368 the arm 12 (FIG. 1B) also carries a rotatable disc 43 mounted so that its outer circumference is tangential to the line at point 26 which is the datum point 39° (at 67° F entering wet bulb temperature) on scale 20. On disc 43 are a plurality of radial lines 48,48*a*,48*b*, each labeled to represent the number of rows of tubes in an evaporator.

Along radial lines 48,48*a*,48*b* on disc 43 are numbers defining air velocities from 400 feet per minute close to the axis of the disc to 500 feet per minute near the periphery of the disc. The outer circumference of the disc represents 525 feet per minute. These numbers refer to the velocity of indoor air (air to be cooled passing through the evaporator) that is to be used in conjunction with an evaporator as will be more fully discussed below. Further, numbers may be located on radii 48, 48*a*, and 48*b* indicating the resistance to air flow at each velocity of air through the evaporator.

Second arm 40 is also pivoted at 14 to the base 10 and is also offset so that one edge lies on a radius 14-C. Along the edge of this arm is a scale 44 denoting the Evaporator Face area in square feet, and adjacent thereto is a corresponding scale 50 denoting cubic feet per minute (CFM) at a velocity of 525 feet per minute representing in each case the maximum practical volume of air for that surface (face) area, and representing a correction factor of 1.0 for the evaporator. This, however, does not select a specific evaporator.

In order to make a selection among many available standard commercial evaporators (none of which will be expected to operate at a correction factor of 1.0, nor is it desired to use air velocities over 525 feet per minute) there are several lines 45, 45*a*, 45*b* parallel to the radial edge 14-C of arm 40, labeled near the pivot 14 to indicate one dimension (in inches) of an evaporator, and along each line, are marks 46,46*a*, etc. indicating the tube length in inches. It will be noted that the location of the mark indicating the tube length (46,46*a*,46*b*) for any line (45,45*a*,45*b*) indicating the "one-dimension" of an evaporator will fall at the radial distance from pivot 14 such that the area of that specific evaporator will correspond to the evaporator area indicated on scale 44 at the edge of the arm 40 at that radial distance.

If arm 40 is swung down to the radius 14-A any evaporator having the area indicated by scale 44 opposite any B.T.U.H. indicated on line 14-A, will for an 8 row, 12 fins per inch on a ⅝ inch diameter tube evaporator as indicated by the legend at 47 at the periphery of the quadrant be satisfactory. This assumes a correction factor of 1.0 (39° F refrigerant-temperature entering the compressor at 67° F entering wet bulb temp.) and an air velocity of 525 feet per minute, to remove the indicated B.T.U.H. listed on radius 14-A.

Figure 1B:
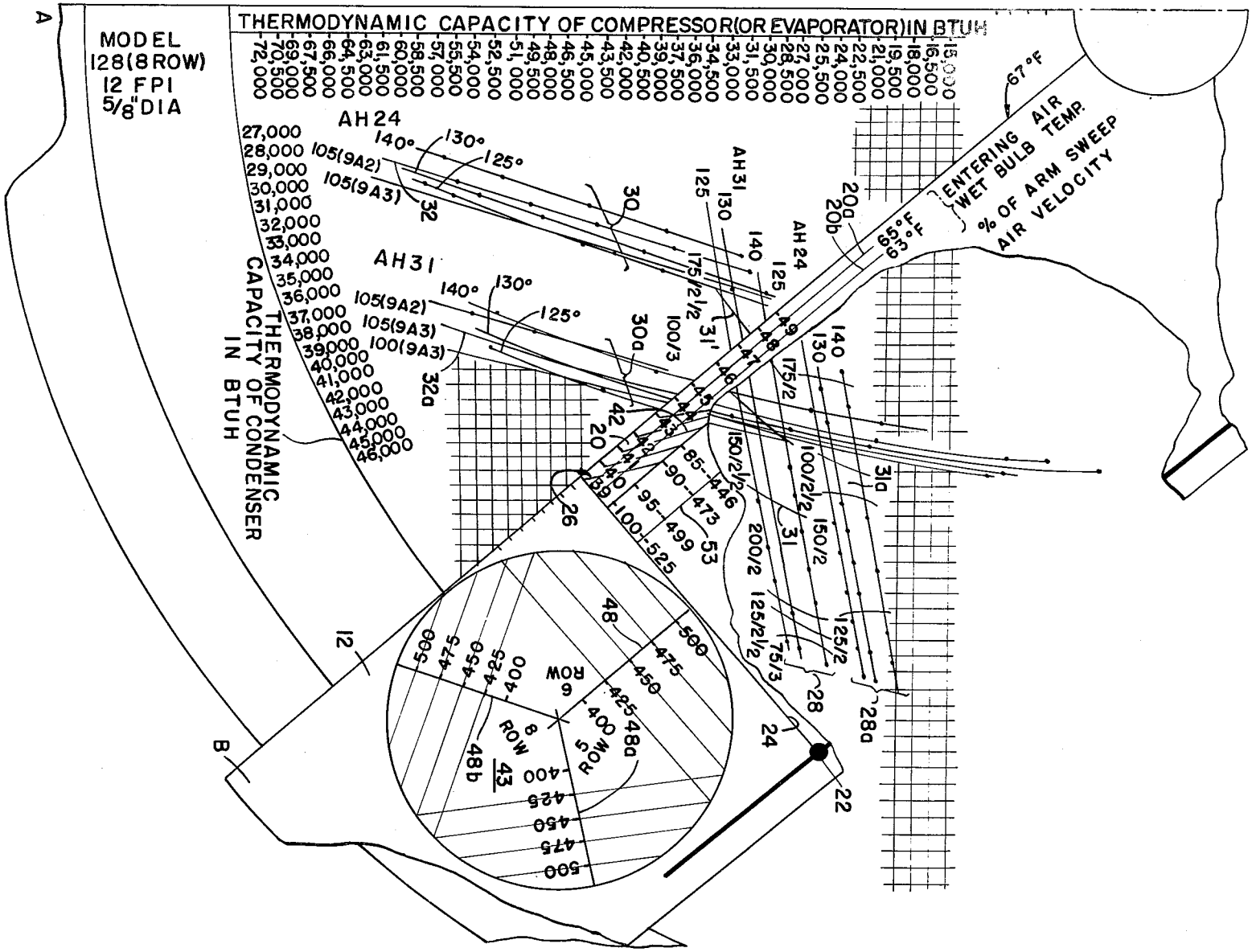
FIG. 1B is an enlarged view of the first quadrant with part of the pivotable arm broken away.

Since it is desired to use an air velocity through the evaporator lower than 525 feet per min., and it is desired to use a correction factor of less than 1.0, it is necessary to provide a means to choose which of the evaporators having one dimension indicated at the ends of lines 45,45*a*,45*b*, and a tube length that will be suitable according to indicia 46,46*a*,46*b*, spaced along lines 45,45*a*,45*b*, for the installation being considered. Lines 45,45*a*,45*b* each indicate one physical dimension (in inches in this case) of standard evaporators and the indicia 46,46*a*, etc. on each line 45,45*a*, etc., indicate the other physical dimension in inches of an evaporator, so that, as seen in FIG. 1A, an evaporator 6 × 36 inches (line 45), an evaporator 9 × 24 inches (line 45*a*), and an evaporator 12 × 18 inches (line 45*b*) each have an area of about 216 square inches or about 1.5 sq. ft. So it is clear that, according to the dimensions of the space architecturally available, one or other of these evaporators might be chosen. It will be noted that this is the area of the opening through which the air must pass — not the cooling area of the tubes in the evaporator.

To choose an evaporator to complement the compressor and condenser chosen by use of arm 12, scale 20, and curves 28, and 30 as fully described in U.S. Pat. No. 3,878,368, the procedure is that the datum point 26 at 39° on scale 20 is placed as it was used to select the compressor. The lines of hatching of the quadrants normal to radius 14-A are used, as they are in U.S. Pat. No. 3,878,368, to lead the eye of the operator from the readings of B.T.U.H. on radius 14-A, to the scales on arms 12 and 40.

Following the line from datum 39° across, past radius 14-A, to the several scales on the arm 40, the arm 40 is swung so that radius 14-C lies on one of the radial lines, 47,47*a*,47*b*, etc. around the edge of the quadrant each of which is labeled by catalogue number of a manufacturer including the number of rows of tubes, tube diameter and number of fins per inch for an evaporator made by that company.

The dimensions of the evaporator will be dictated by the space available which is limited by architectural features of the building to be served. We noted above that for an installation requiring about 1.5 square feet of evaporator any one of three standard dimensions would be suitable but it is still necessary to determine whether, in order to use one of these evaporators, the air velocity required through the evaporator would be within the desired range.

The B.T.U.H. delivered by an evaporator indicated on, say, radial indicator 47*b* will be the B.T.U.H. indicated on line 14A opposite a mark 46 (46*a*,46*b*) on one of the lines 45,45*a*,45*b*. That is, a "Model 88", eight row, with eight fins per inch could be selected of dimensions: 6 inches by 36 inches; 9 by 24 inches, or 12 by 18 inches, to remove between 45,000 B.T.U.H. and 45,500 B.T.U.H. at 525 FPM air at a correction factor of 1.0.

If the indicia at the edge of arm 40 indicating the evaporation area is closer to pivot 14 than the line from datum 39° on arm 12 to line 14-A, (45,000 BTUH) none of the evaporators with only 1.5 sq. ft. area would operate within the acceptable limits of air velocity. On the other hand if the 1.5 square foot mark on arm 40, when swung down falls below the line from datum 39° on scale 20 to line 14-A, there may be an evaporator of that area that would be suitable. The right edge of arm 40, then, may be moved first to the left in FIG. 1 until the 1.5 square foot mark swings up to the line from datum 39° to line 14-A then, locating the right hand edge 40 so it falls successively on radial lines 47*b*,47*a*, where, at the edge of the quadrant the model numbers of possibly suitable evaporators are indicated. Moving the right edge of arm 40 to one of the lines 47*a* denoting a specific evaporator to the right of the limit position of arm 40 (where the mark for 1.5 square feet is at the line from the datum 39° to 14-A) the point on scale 44 for 1.5 square feet will fall on a line extending from 1.5 square feet past radius 14-A and will meet the left edge of arm 12 radially outwardly of datum 39°.

As pointed out above the periphery of the disc 43 lies at the same place on scale 20 as does the datum 39°. As the arm 40 is swung to the right, it will bring the point indicating 1.5 square feet to lines radially outwardly of the datum line (39° to line 14-A) and, when positioned on a radial line 47*b*, etc. indicating a specific catalogue number of an evaporator, the line from the 1.5 square foot mark past radius 14-A will fall on scale 20 radially outwardly of datum 39° and of the velocity datum 525FPM of the edge of disc 43. If this line (from 1.5 square feet past radius 14-A) falls at a point on the scale 48 (projected normally to the edge of arm 12) opposite, say, the 475 fpm mark on the radius of disc 43 that has been rotated so that the radius of disc 43 parallel to scale 20 refers to the number of rows of tubes corresponding to the number of rows of tubes indicated for the specific evaporator tentatively chosen as indicated at 47*b* — it may well be that that would be the evaporator selected. It may be, however, that another setting of the right edge of arm 40 on a different radial mark at 47*a* would indicate an air velocity of 450 fpm which might be a better selection in a specific case due to available fans or other factors, such as the power required for the fan or because of a possibility of the indoor air temperature requiring a speed-up of the airflow through the evaporator in excessively hot weather, which could be accommodated by increasing the speed of the fan by adjustment of the V belt drive from its motor.

If, on the other hand, the dimensions of the evaporator are not limited by the architectural requirements, a far wider selection of evaporators may be available, and some may well be less expensive than others.

As disclosed in U.S. Pat. No. 3,878,368, a given evaporator, at given conditions (entering wet bulb temperature and air velocity) will have a fixed percentage reduction in capacity corresponding to each refrigerant temperature (entering the compressor). As disclosed in U.S. Pat. No. 3,878,368 if the fixed pointer 26 (39°) on arm 12, is located opposite the datum capacity on radius 14A representing the correction factor of 1.0, and moveable pointer 24 on arm 12 is located opposite the desired capacity on radius 14A the required refrigerant temperature (entering the compressor) will be located on scale 20 directly below moveable pointer 24. As disclosed in U.S. Pat. No. 3,878,368, the corresponding percentage reduction in capacity value would also be found directly below moveable pointer 24 on scale 18 on arm 12.

The B.T.U.H. delivered by an evaporator that has a refrigerant temperature (entering the compressor) of other than 39° F (at 67° F entering air wet bulb temperature), will be the B.T.U.H. indicated on line 14A opposite that value on scale 20. The right edge of arm 40 then is moved, to, say, radial indicator 47*b*. The corresponding area is found at the line from the datum 39° to 14-A and extending past to scale 44 on arm 40. That is, a "Model 88", eight row, with eight fins per inch could be selected of dimensions: 6 inches by 36 inches; 9 by 24 inches, or 12 by 18 inches to remove 32,000 B.T.U.H. at 525, FPM air at 47.5° F refrigerant temperature (entering the compressor) at 67° F entering air wet bulb temperature. See FIG. 2.

The arm 40 also has a scale 51 at its outerextremity denoting the entering air wet bulb temperature in ° F. The base 10 also has at its outermost rim curves 52 denoting the leaving air wet bulb temperature in ° F, (only a few wet bulb temperatures are shown in the drawing because of the necessary of lettering). The leaving wet bulb temperature corresponding to a given evaporator model (rows, fins per inch, and diameter) at a correction factor of 1.0 (525 feet per minute and 40° F refrigerant temperature) will be located on curve 52, directly below the desired entering wet bulb temperature when arm 40 is positioned on that desired model number 47B (47*a*, etc.). That is, for the example above for an entering air wet bulb temperature of 67° F the leaving air wet bulb temperature is 47.2° F. The arm 12 can have a linear scale 53 (525 fpm at point 26 and 0 fpm at pivot 14) denoting air velocity in feet per minute to be used in conjunction with the scales 20, 44, and 51 for determining leaving wet bulb temperature values 52 at correction factors of other than one. The arm 12 has lines 42 at an angle to its edge extending from scale 20 which provide, by lines 20*a*, and 20*b* scales for different entering wet bulb temperatures, with constant refrigerant temperature (entering the compressor) lines 42 running diagonally to these 20 scales to permit interpolation.

The groups of lines 28 and 28*a* each have several lines 31 or 31*a* extending across each group. These lines are marked to indicate the catalogue number of a standard thermostatic expansion valve to permit a selected compressor. These lines 31, 31*a* etc. are constant pressure drop/thermostatic value model lines. The thermostatic value to be selected will be the one lying at or close to the scale 20 preferably lying to the left. That is, for the example of above a thermostatic expansion valve (31') model 2½ at a pressure drop of 175psi will be compatible with the selected evaporator and the selected compressor model AH31 which has an entering refrigerant temperature of 47.5° F and a leaving refrigerant temperature at 134° F. If a different pressure drop is desired (or required) a different thermostatic expansion valve model would be required and would be determined by interpolation between various lines 31, or 31', etc.

The groups of lines 30, and 30*a* also have lines 32 extending across each group. These lines are each marked to indicate the catalogue number of a standard air cooled condenser to permit selection of an appropriate air cooled condenser to suit the selected compressor. These lines 32 are constant ambient air temperature/air cooled condenser model lines. The air cooled condenser to be selected will be from a line lying at or close to the scale 20 but preferably lying to the right. That is, for the example above; an air cooled condenser model 9A2 at an ambient air temperature of 105° F will be too small, and the model 9A3 at the same ambient air temperature is too large but is compatible with the selected evaporator, compressor, and thermostatic expansion value. If a different "design" ambient air temperature is desired (or required) a different air cooled condenser model would be required and would be determined in interpolation between various lines 32, 32*a*,32*b*, etc.

The groups of lines 30, and 30*a* could alternatively have lines extending across each group these lines which would be marked to indicate the catalogue number of standard *water cooled* condensers and evaporative condensers to permit selection of an appropriate *water cooled* condenser or evaporative condenser to suit the selected compressor.

If desired, a magnifying glass could be mounted on the moveable pointer 24. The glass could be large enough, so shaped and located on the pointer so that values near the pointer on the base and arm 12 could be easily read. A magnifier could also be provided to read the temperatures on scale 52.

If desired, the temperature reading of the water entering a water cooled condenser could be changed to read the temperature of the water leaving the water cooled condenser. Also, water pressure drop could be marked next to the gpm (water flow rate through a water cooled condenser) values (for the given water temperature rise).

The device of this invention may be made having four quadrants, that is to have the base 10 be a full disc. Each quadrant may, then be provided with a tabulation along its left hand radius denoting B.T.U.H. required for an installation and each quadrant may, then carry sets of curves 28,28*a*, and 30, and 30*a* referring to compressors and to condensers respectively that would be suitable for service to provide for the B.T.U.H. indicated for that quadrant. While the same arm 12 pivoted at 14 would be used in each quadrant, different scales would need to be mounted on arm 40 to suit the quadrant in which it was to operate, or additional arms 40 could be provided.

Having thus disclosed my invention I claim:

1. In a selector for choosing components for thermodynamic systems such as air conditioning systems, in which said components include a compressor, a condenser, an expansion valve and an evaporator said selector comprising a planar base, an arcuate chart on said base, a pivot on said base, said pivot establishing a point of origin for said chart, a half line on said base extending from said point of origin, indicia on said half line expressing thermodynamic capacities expressed in B.T.U.H. from a minimum near said point of origin to a maximum at a position remote from said point of origin required by said system, said halfline dividing said chart into at least a first and a second quadrant, at least one set of curves (28) on said first quadrant representing thermodynamic information necessary for selection of a compressor, at least one second set of curves (30) on said first quadrant representing information necessary for selection of a condenser suitable for use with the selected compressor, a first pivoted arm extending from said point of origin as a pivot across said first quadrant said arm including a datum point (26) and a first scale expressed in units of temperature extending from said datum point decreasing toward said point of origin, said scale reading 39° F at said datum point, a second scale on said first pivoted arm referring to a correction factor of 1.0 at said datum point and diminishing to 0.0 at said point of origin, a movable pointer (24) on said first pivoted arm to be positioned along said first pivoted arm to indicate on said scales on said arm temperatures and correction factors determined in connection with the selection of said compressor by use of said scales and pointer; the improvement including at least one scale on said first pivoted arm extending radially outwardly from said datum point expressed in units of air velocity reading 525fpm at the datum point (26), to a velocity of 400cfm radially outwardly thereof, and a second pivoted arm extending from a pivot at said point of origin to overlie said second quadrant, said second pivoted arm being provided with a plurality of scales extending there along; a scale reading in square feet of area of an evaporator; C.F.M. of air that is necessary for an evaporator of that area at 525fpm and a correction factor of 1.0; and at least one scale denoting dimensions of standard evaporators, and a plurality of radial lines lying near the edge of said chart each said radial line indicating an evaporator by catalogue number and other pertinent data, whereby, after a compressor has been selected, a complementary evaporator may be selected by catalogue number.

2. The selector of claim 1 including also on said second pivoted arm indicia relating to entering air wet bulb temperatures, and indicia on said chart indicating the wet bulb temperatures of air leaving the evaporator.

3. The selector of claim 1 including a disc pivoted to said first pivoted arm radially outwardly of said datum point; the periphery of said disc lying at said datum point, a plurality of scales each extending along a radius of said disc including indicia expressed in air velocity fpm reading from the periphery of said disc radially inwardly of said disc, each said scale on said disc referring to a different specified type of evaporator whereby, by rotation of said disc, said scales may be successively positioned to be parallel to said first arm.

4. The selector of claim 1 in which said first scale on said first pivoted arm expressed in units of temperature refers to the refrigerant temperature delivered to the compressor under the design conditions when the ambiant air entering the evaporator is at a temperature of 67° F wet bulb, and at least one scale (*20a,20b*) is provided parallel to said first scale that refers to the temperature of the refrigerant when the ambient air entering the evaporator is at a different identified lower temperature.

5. The selector of claim 1 including also a plurality of constant pressure-drop lines (31) intersecting said set of curves (28) on said first quadrant representing thermodynamic information necessary for selecting a compressor, said constant pressure curves being each identified by a manufacturer's catalogue, and each positioned with relation to said set of curves to identify a thermostatic valve appropriate for use in the thermodynamic system being designed.

6. The selector of claim 1 in which said second set of curves (30) on said first quadrant representing thermodynamic qualities necessary for selecting a condenser represent the temperatures of the refrigerant entering the condenser and also including constant temperature lines each said line identifying by catalogue number a condenser that may be selected.

7. The selector of claim 1 in which said base is provided, in an arcuate pattern on an area over which said second arm swings, with lines (52) thereon indicating wet bulb temperatures of air leaving the evaporator and indicia (57) is provided on said second arm expressing the wet bulb temperature of air entering the evaporator whereby it can be determined by noting the position of said lines in said area with respect to said indicia on said arm for each model of evaporator to determine whether that evaporator will be suitable for the system being designed.

* * * * *